US011459741B2

(12) United States Patent
Mallouk

(10) Patent No.: US 11,459,741 B2
(45) Date of Patent: Oct. 4, 2022

(54) WALL-MOUNTED SANITARY EQUIPMENT

(71) Applicant: Yves Mallouk, Le Tréport (FR)

(72) Inventor: Yves Mallouk, Le Tréport (FR)

( * ) Notice: Subject to any disclaimer, the term of this patent is extended or adjusted under 35 U.S.C. 154(b) by 191 days.

(21) Appl. No.: 16/604,155

(22) PCT Filed: Apr. 4, 2018

(86) PCT No.: PCT/IB2018/052323
§ 371 (c)(1),
(2) Date: Oct. 9, 2019

(87) PCT Pub. No.: WO2018/189625
PCT Pub. Date: Oct. 18, 2018

(65) Prior Publication Data

US 2020/0149258 A1 May 14, 2020

(30) Foreign Application Priority Data

Apr. 11, 2017 (FR) ..... 1753171

(51) Int. Cl.
*E03C 1/324* (2006.01)

(52) U.S. Cl.
CPC ..... *E03C 1/324* (2013.01); *E03C 2201/90* (2013.01)

(58) Field of Classification Search
CPC ..... E03C 1/324
USPC ..... 4/644
See application file for complete search history.

(56) References Cited

U.S. PATENT DOCUMENTS 1,648,386 A * 11/1927 Grover ..... E03C 1/14 4/630
5,417,348 A * 5/1995 Perrin ..... B67D 1/0059 137/606
2015/0059085 A1* 3/2015 Seibt ..... F26B 21/004 4/638

FOREIGN PATENT DOCUMENTS

CN 2097597 U 3/1992
FR 2866546 A1 8/2005

OTHER PUBLICATIONS

International Search Report for PCT/IB2018/052323 dated Jul. 9, 2018.
Preliminary Search Report for France Patent Application No. 1753171 dated Nov. 8, 2017.

* cited by examiner

*Primary Examiner* — Huyen D Le
(74) *Attorney, Agent, or Firm* — Thomas | Horstemeyer LLP

(57) ABSTRACT

Wall-mounted sanitary equipment comprises a support supporting a water supply means; a tap support means on which a tap is attached; a funnel and a platform having a bottom and a peripheral edge, such that the platform is configured to form a basin under the dispensing head of the tap, the funnel having an upper collection opening for collecting wastewater originating from the platform, the funnel further comprising a lower discharge end connected to a wastewater collection means, the bottom of the platform being pivotably mounted between two positions, a first position in which said platform is folded in the vertical position and a second position in which said platform is kept horizontal in order to act as a basin.

25 Claims, 4 Drawing Sheets

WALL-MOUNTED SANITARY EQUIPMENT

CROSS-REFERENCE TO RELATED APPLICATIONS

This application is a § 371 national phase application of PCT/IB2018/052323 filed Apr. 4, 2018 entitled "WALL-MOUNTED SANITARY EQUIPMENT," which claims the benefit of and priority to France Patent Application No. 1753171 filed Apr. 11, 2017 entitled "EQUIPEMENT SANITAIRE MURAL," published as France Patent Publication No. FR3065016, the contents of which being incorporated by reference in their entireties herein.

TECHNICAL FIELD

The present invention relates to the field of sanitation, and particularly relates to a transportable wall-mounted sanitary equipment, which can be installed on a wall or partition, or recessed into a wall or partition.

BACKGROUND

Traditional sanitation washbasins include a basin whose depth and width depend on the application, which is to be fixed horizontally on a wall or carried horizontally by a support or a column, so that in all cases, the horizontal washbasin occupies considerable space and thus constitutes an obstacle for people moving inside a room where the washbasin is installed.

Moreover, in some places, including means of transport (for example, trains, boats, bus, airplanes or caravans) or habitat cramped rooms, the interior space of grooming is sometimes minimal, leading to an uncomfortable movement problem of the user within the room in which the sanitary elements occupy almost all the space, thereby preventing the user to move with ease in said part.

Sanitary facilities folding sinks have been made to try to solve the problem mentioned above; however, these existing folding sinks have connection problems during assembly and disassembly of sanitary facilities, problems of embedding into the partitions of thin walls, and aesthetic problems and discretion.

PCT International Application WO2011/027017 discloses a folding sink whose basin is pivotally mounted on a main body mounted on a wall so that the basin of the folding sink is either in a position of use or in a folded position, the basin of the folding sink pivoting around an axis in the form of a discharge tube for draining the water from the basin, and a tap being mounted on the main body. However, the wastewater outlet pipe does not make it possible to optimally achieve the flow of wastewater to a wastewater outlet. In addition, the wastewater outlet tube of this folding sink does not allow the passage of water supply pipes therethrough, which makes the connection of the tap to the water arrivals more voluminous, which makes it less convenient to assemble and disassemble the folding sink or the tap, and this makes it more difficult to access the connections of the sanitary ducts and the evacuation of wastewater. In addition, this sink is not configured to be embedded in a wall to further reduce its size in the room in which it is installed.

Chinese utility model CN203088914U discloses a box containing a funnel and a pivoting basin without describing the equipment of the means of feeding and evacuation.

Chinese utility model CN2097597U discloses a box containing a funnel, a pivotal basin and taps fed from the rear of the box. However, this configuration requires creating passages at the back of the box or in the wall. In addition, this sink is not configured to further reduce its size in the room in which it is installed.

BRIEF SUMMARY OF THE INVENTION

The present invention aims to solve the disadvantages of the prior art, by proposing a wall-mounted sanitary equipment, optionally transportable, which can be embedded in a wall or a partition or disposed, in particular by attachment, against a wall or a partition, which wall-mounted sanitary equipment comprises a tap, a platform for forming a basin under the tap and a funnel-type wastewater collection means disposed under the platform. The wall-mounted sanitary equipment is preferably in the form of a box to reduce the size of the wall-mounted sanitary equipment and facilitate its assembly/disassembly, and the platform is pivotally mounted along a horizontal axis to reduce the clutter of the wall-mounted sanitary equipment when the platform is in a storage position.

The present invention therefore relates to a wall-mounted sanitary equipment, comprising a support supporting:

1—Wall-mounted sanitary equipment, comprising a support supporting:

- a water supply means;
- a tap support means, configured to receive a tap carrying a rotatable dispensing head, said tap support means being configured to sealingly connect the tap to the supply means water;
- a means of collecting wastewater; and
- a platform having a bottom and a peripheral edge surrounding at least part of the bottom so that the platform is configured to form a basin under the dispensing head of the tap,
  - the wastewater collection means comprising a funnel having an upper collection opening for collecting wastewater from the platform, the funnel further comprising a lower discharge end sealingly connected to a wastewater receiving means, the bottom of the platform being pivotally mounted between two positions, a first storage position, wherein said platform is folded in a vertical position, and a second position, said use, wherein said platform 1 is held horizontally by a stop means to serve as a basin that guides the water distributed by the tap to the wastewater collection means, the bottom of the platform extending, in the position of use, overhanging above the collection opening of the funnel, the peripheral edge of the bottom overhanging above the collection opening of the funnel having at least one opening to allow the wastewater from the platform to pass to the funnel, the wall-mounted sanitary equipment further comprising a filtering means disposed on a filter support and configured to filter the wastewater before passing to the means for receiving the wastewater, characterized in that the filter medium support comprises at least one aperture configured to allow passage of the water supply means therethrough and the funnel comprises at least one aperture configured to allow the passage of the water supply means sealingly therethrough.

Thus, the pivoting of the platform substantially upright storage position reduces the size of the wall-mounted sanitary equipment when it is not used, thus allowing the user to move easily in the room in which the wall-mounted sanitary equipment is installed. In addition, the pivoting of the platform in the substantially horizontal use position allows the bottom of the platform to be used as a basin in order to receive water flowing from the dispensing head of the tap.

In addition, at least one opening in the filtering means and at least one opening in the funnel allows passage of the water supply means to further reduce the bulk of the wall-mounted sanitary equipment.

The funnel preferably has a flared shape so as to achieve an optimal flow of wastewater to the wastewater receiving means.

The filtering means makes it possible to coarsely filter the wastewater flowing from the bottom of the platform in order to prevent objects from clogging the evacuation system.

The rotating dispensing head of the tap allows to position it above the bottom of the platform when the platform is in the position of use.

The tap can be sold with or without the assembly according to the invention, and can easily be replaced or changed according to the wishes of the user.

According to a variant of the invention, the filtering means is arranged upstream of the collection opening of the funnel.

According to another variant of the invention, the filtering means is disposed downstream of the funnel collecting opening.

According to a first embodiment of the invention, the filter medium support is the bottom of the platform, and the filtering means is constituted by a removable filtering grid disposed upstream of the at least one opening in the platform.

Thus, the filtering grid makes it possible to coarsely filter the wastewater that flows into the funnel from the bottom of the platform to prevent objects from falling into the funnel and clogging it, the filtering grid being removable to facilitate maintenance of the funnel.

The filtering grid is preferably a toothed plate in order to allow the flow of water and the retention of objects, said toothed plate being preferably mounted under a horizontal support placed on the stop means and/or the means tap support, said horizontal support for placing objects thereon.

According to a second embodiment of the invention, the filter medium support is the bottom of the platform, and the filtering means is constituted by a comb-shaped cut formed on the edge of the bottom of the overhanging platform above of the funnel collection opening.

Thus, the comb-shaped cut allows coarse filter wastewater flowing into the funnel from the bottom of the platform to prevent objects from falling into the funnel and plug it.

According to a third embodiment of the invention, the filter medium support is the bottom of the platform, and the filtering means is constituted by perforations formed in the bottom of the overhanging platform above the collection opening. funnel in the use position of the platform.

Thus, the perforations in the bottom of the platform can be used to coarsely filter the wastewater flowing into the funnel from the bottom of the platform to prevent objects from falling into the funnel and clogging it.

According to a fourth embodiment of the invention, the filter medium support is the bottom of the platform, the funnel comprises a rear wall, and the filtering means is constituted by a spacing of between 1 mm and 10 mm, preferably equal to 2 mm, between the edge of the bottom of the overhanging platform above the funnel collecting opening and the point of the rear wall of the funnel furthest from said shelf bottom edge in the plane of the bottom of the board in the position of use of the platform.

Thus, the reduced spacing between the bottom edge of the platform and the rear wall of the funnel allows coarse filter wastewater flowing into the funnel from the bottom of the platform to prevent objects do not fall into the funnel and close it.

According to a fifth embodiment of the invention, the filter medium support is the discharge end of the funnel, and the filtering means is constituted by at least one filtering grid disposed in the end of the filter evacuation of the funnel.

Thus, the filtering grid in the discharge end of the funnel makes it possible to coarsely filter the wastewater flowing in the means for receiving wastewater from the funnel in order to prevent objects from falling into the funnel the means of receiving the wastewater and do not clog it.

According to a particular feature of the invention, the assembly further comprises a tap fixed on the tap support means, the water supply means is constituted by at least one sealed connection to at least one water inlet and the wastewater receiving means is constituted by a sealed connection to a wastewater outlet sealingly connected to the discharge end of the funnel, the tap being sealingly connected to each inlet connection of water through a respective water supply pipe, each water supply pipe sealingly traversing the sidewall of the funnel to connect the tap to the corresponding water inlet connection.

Thus, each water supply pipe passes into the volume of the funnel and passes through the sidewall of the funnel, in such a way that the overall size of the internal connection of the sanitary equipment is reduced, the connection of the wall-mounted sanitary equipment at the wastewater outlet connection and each water supply connection is further simplified. The overall size of the support is thus reduced.

According to a particular characteristic of the invention, the various elements of the wall-mounted sanitary equipment are made of plastic and/or metal.

In addition, the extension of the platform above the funnel collection opening and the at least one opening in the platform allow the flow of wastewater present in the bottom of the platform only in the funnel and then in the wastewater receiving means, the at least one opening in the platform preferably being an opening in the peripheral edge of the portion of the platform extending above the collection opening in the funnel.

According to a particular characteristic of the invention, each water supply pipe is a flexible pipe passing through a rigid guide tube which is arranged in the funnel and which passes through the sidewall of the funnel, or a malleable metal pipe sealingly traversing the sidewall of the funnel.

Thus, the rigid guide tube, preferably welded to the sidewall of the funnel, allows the corresponding water supply hose to pass through the sidewall of the funnel in a sealed manner to then be connected to the corresponding water supply.

Each flexible hose is preferably a rubber tube coated with a metal weave.

Each malleable metal pipe is preferably an annealed copper pipe.

Said malleable metal pipe is preferably configured to be clampably bloked to the sidewall of the funnel through an O-ring nut configured to be screwed onto a thread disposed on the outer face of the wall side of the funnel. Thus, screwing the O-ring nut onto the thread disposed on the sidewall of the funnel allows the malleable metal pipe to pass sealingly through the sidewall of the funnel while being locked in position.

Each water supply pipe passes through the sidewall of the funnel either on the side of the discharge end of the funnel, or on the side of the funnel collection opening, in which case the risks of capping of the discharge end of the funnel are decreased.

According to a particular characteristic of the invention, the tap support means is a horizontal support fixed to the support overhanging the funnel, each water supply pipe being sealingly connected to a corresponding inlet of the water tap.

According to a particular feature of the invention, the tap comprises two water inlets each sealingly connected to a respective water supply pipe, the tap being one of mixer single-lever or mixer dual-lever.

Thus, the tap may, for example, include a cold water inlet connected to a cold water inlet by a cold water supply pipe and a hot water inlet connected to a hot water inlet by a hot 40 water supply pipe, the mixer with single-lever or mixer with dual-levers adjust the temperature of the water out of the mixer dispensing head according to the order of the user.

According to a particular feature of the invention, the wall-mounted sanitary equipment further comprises a siphon disposed between the discharge end of the funnel and the wastewater receiving means. Thus, the siphon prevents the rise of odors to the funnel to improve the comfort of user.

According to a particular characteristic of the invention, the platform comprises a handle on the face of the bottom opposite to that serving as a bottom in the use position. Thus, the handle allows the user to rotate the platform to place it in the use position or in the storage position.

According to a particular characteristic of the invention, the abutment means is constituted by two inverted U-shaped parts, one of the branches of the U being intended to abut against the peripheral edge of the platform. Thus, the inverted U-shaped parts make it possible to keep the platform in the substantially horizontal position of use.

According to a particular characteristic of the invention, each U-shaped part consists of two interlocking parts, one of the two parts being fixed and the other of the two parts being removable, said removable part comprising the U-branch intended for abut against the peripheral edge of the platform, said fixed part comprising the other U branch which is fixed on the funnel. Thus, the disassembly of the removable part of the two interlocking parts makes it easy to disassemble the platform of the wall-mounted sanitary equipment.

According to a particular characteristic of the invention, the support of the wall-mounted sanitary equipment is a transportable box, configured to be installed against a wall or recessed in a recess formed in a wall, said box comprising fastening means, the box comprising an upper part comprising the platform and the tap and a lower part comprising the funnel, the depth of the funnel and the height of the peripheral edge of the platform being equal to or less than the depth of the box, and the width of the opening of collecting the funnel being equal to the width of the box. Thus, the box can be configured to be recessed in a wall to further reduce the clutter of the wall-mounted sanitary equipment in the room in which it is installed.

In the case where the box is embedded in a frame wall with metal rails, the box is directly installed on the metal rails using fastening means such as hooks and/or screws. It should be noted that the box could also be installed against a wall, by hooking.

According to a particular characteristic of the invention, the water inlet and wastewater outlet connections consist of holes in the lower part of the box. Thus, the assembly/disassembly of the box is facilitated.

According to a particular characteristic of the invention, the lower part of the box has, on the front face, a removable access door. Thus, the removable access door provides access to the various connections of the wall-mounted sanitary equipment and funnel to facilitate assembly/disassembly and/or repair.

The removable access door may include a locking member such as a lock to limit access of the lower portion of the box to authorized persons.

According to a particular characteristic of the invention, the box comprises hinges and/or hinges fixed to the platform and to the funnel and/or to the support in order to allow the pivoting of the platform between its storage position and its position of use. In the case where the hinges and/or the hinges are removable, they advantageously allow the disassembly of the platform.

According to a particular characteristic of the invention, the box further comprises a locking element in the storage position of the platform. This locking element may for example be a hook, a magnet system or a lock, without this list being limiting. The box also advantageously comprises a locking element of the access hatch.

According to a particular characteristic of the invention, the box further comprises decorative coatings disposed on its front face. Thus, the wall-mounted sanitary equipment is dressed with decorative coatings to improve its aesthetics; the decorative coatings may for example be arranged on the front of the lower part of the box and/or on the bottom face of the platform opposite to the one serving as a bottom in the position of use.

According to a particular characteristic of the invention, the box is parallelepiped rectangle and has a thickness of between 2 cm and 15 cm. These thicknesses are given only as an indication, in the context of a small space-saving embodiment, and the invention is not limited in this respect.

Thus, the small thickness of the box allows the embedding of the box in thin walls.

According to a particular characteristic of the invention, the platform is removable. The hinge and/or hinges allowing pivoting of the platform are, in this case, advantageously removable.

According to a particular characteristic of the invention, the tap support means can be dismantled in order to facilitate the fixing of the tap.

According to a particular characteristic of the invention, the discharge end of the funnel is centered in the width of the lower part of the box, or is shifted towards a lateral side of the lower part of the box, a storage space being provided in the lower part of the box in the case where the discharge end of the funnel is shifted.

To better illustrate the object of the present invention will be described below, by way of illustration and not limited to five preferred embodiments, with reference to the accompanying drawings.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
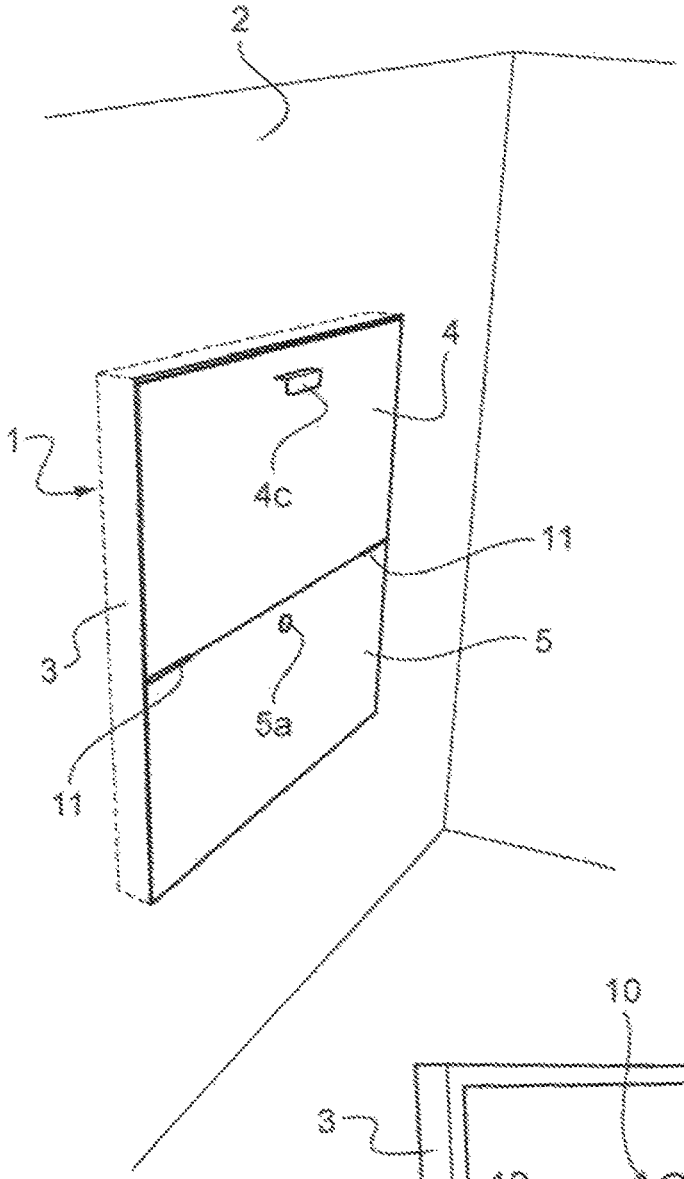
FIG. 1 is a perspective view of a wall-mounted sanitary equipment according to a first embodiment of the present invention, recessed in a wall, in the storage position.
Figure 2:
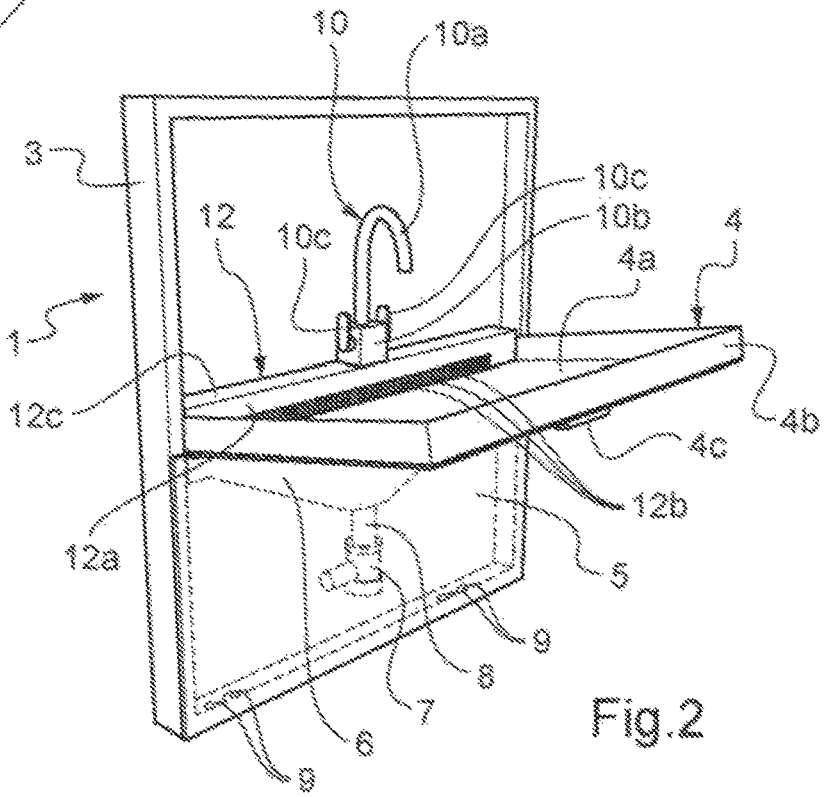
FIG. 2 is a perspective view of the wall-mounted sanitary equipment of FIG. 1 in the use position.

Referring to FIGS. 1 and 2, it can be seen that there is shown a wall-mounted sanitary equipment 1 according to the first embodiment of the present invention.

In FIG. 1, the wall-mounted sanitary equipment 1 is shown embedded in a wall 2.

The wall-mounted sanitary equipment 1 comprises a support constituted by a box 3 recessed in a recess formed in the wall 2, the portion of the box 3 embedded in the wall being shown in dashed lines in FIG. 1 to facilitate understanding of the reader.

It should be noted that the wall-mounted sanitary equipment 1 may not include box 3, the support then being constituted by the wall frame, without departing from the scope of the present invention.

The box 3 includes 3 comprises fixing means (not shown in FIGS. 1 and 2) such as hooks and/or screws in order to fix the box 3 in the recess formed in the wall 2.

In the case where the box 3 is embedded in a frame wall with metal rails, the box 3 is directly installed on the metal rails using the fastening means.

The embedding of the box 3 in the wall 2 thus further reduces the size of the wall-mounted sanitary equipment 1 in the room in which it is installed.

It should be noted that the box 3 could also be installed against the wall 2 by simply hooking, without departing from the scope of the present invention.

The box 3 comprises an upper part comprising in the front part a platform 4, and a lower part comprising in the front part a removable access hatch 5.

In FIG. 2, the elements behind the removable access door 5 have been shown in dotted lines to facilitate understanding of the reader.

The wall-mounted sanitary equipment 1 comprises, in the lower part of the box 3, a funnel 6 sealingly connected to a siphon 7 placed between a discharge end 8 of the funnel and a wastewater discharge connection, the wastewater discharge connection being constituted by one of the holes 9 in the lower part of the box 3.

The wall-mounted sanitary equipment 1 further comprises, in the upper part of the box 3, a tap 10 mounted on a horizontal support (not shown in FIG. 2 and which will be described in more detail in FIG. 5, and having a dispensing head 10*a*, the funnel 6 being positioned under the tap 10.

The funnel 6 flares from its siphon-end 7 towards its tap-side end 10, the funnel 6 having a rectangular collection opening (not shown in FIG. 2 and which will be described in 15 more detail in FIG. 5) level of its end, tap side 10.

Thus, the flared shape of the funnel 6 makes it possible to achieve an optimal flow of wastewater towards the discharge of wastewater.

The platform 4 has a bottom 4*a* and a peripheral edge 4*b* surrounding the bottom 4*a*.

The platform 4 is intended to form a basin under the tap 10, at least a portion of the bottom 4*a* of the platform 4 extending above the rectangular collection opening of the funnel 6.

The depth of the funnel 6 and the height of the peripheral edge 4*b* of the platform 4 are equal to or less than the depth of the box 3.

The casing 3 has a thickness of between 2 cm and 15 cm.

Thus, the small thickness of the box 3 allows the embedding of the box 3 in thin walls.

The thickness of the box 3 is preferably 4 cm.

The removable access door 5 provides access to the various connections of the wall-mounted sanitary equipment 1, the funnel 6 and the siphon 7 to facilitate the assembly/disassembly and/or repair of the wall-mounted sanitary equipment 1, a notch 5*a* in the removable access door 5 allowing the opening/closing thereof by a user. Locking means of the hatch in the closed position, of the magnet, hook or similar type, may advantageously be provided.

The removable access door 5 could also include a locking element such as a lock to limit access of the lower part of the box 3 to authorized persons.

It should be noted that the funnel 6, which is centered in the lower part of the box 3 in this first preferred embodiment, could also be shifted to a lateral side of the lower part of the box 3, a storage space which can this case also be provided in the lower part of the box 3, without departing from the scope of the present invention. The upper opening, called collection opening, of the funnel 6 would in this case keep the same width, or a smaller width, and the funnel 6 would no longer be symmetrical with respect to a central vertical axis of the box 3, its end being evacuation being shifted towards one of the sides of the box 3, to provide a storage space under/next to the funnel 6, in the lower part of the box 3.

The platform 4 is pivotally mounted along a horizontal axis, said platform 4 being pivotally in between two positions, a first storage position, as shown in FIG. 1, in which said 5 platform 4 is folded over the tap 10, and a second position, said use, as shown in FIG. 2, wherein said platform 4 is held horizontally by a stop means (not shown in FIG. 2 and which will be described in more detail with reference to FIG. 5).

It should be noted that the platform 4 could also be removable, without departing from the scope of this.

Hinges 11 that are fixed to both the platform 4 and the funnel 6 allow pivoting of the platform 4 between its storage position and its use position.

Thus, the pivoting of the platform 4 in substantially vertical storage position reduces the size of the wall-mounted sanitary equipment 1. The pivot axis of the platform 4 corresponds to the upper edge of the front wall of the funnel 6.

In addition, the pivoting of the platform 4 in the substantially horizontal use position makes it possible to use the bottom 4*a* of the platform 4 as a basin in order to receive the water flowing from the dispensing head 10*a* of the tap 10.

The platform 4 comprises a handle 4*c* on the face of the bottom 4*a* opposite to that serving as a platform in the use position, the handle 4*c* allows the user to rotate the platform 4 to place it in the position of use or in the storage position.

It should be noted that the box 3 could also include a locking element in the storage position of the platform 4, such as a hook, a magnet system or a lock, without departing from the scope of the present invention.

The dispensing head 10*a* of the tap 10 is rotatable and can thus be turned by the user so as not to hinder the closure of the platform 4 in the storage position.

The tap 10 is a mixing tap and further comprises a mixer 10*b* with two controls 10*c*.

It should be noted that the tap 10 could also be a mixing tap, without departing from the scope of the present invention.

The tap 10 thus preferably comprises a cold-water inlet and a hot water inlet, the mixer 10*b* for adjusting the temperature of the water leaving the dispensing head 10*a* of the tap 10 according to the control of the controls 10*c* of the mixer 10*b* by the user.

The wall-mounted sanitary equipment 1 further comprises a filtering means disposed on a filter medium support and configured to filter the wastewater before passing through the wastewater outlet. In the first embodiment, the filter medium support is the bottom 4*a* of the platform 4 and the filtering means is a removable filtering grid 12 arranged upstream of the funnel 6.

The filtering grid 12 makes it possible to coarsely filter the wastewater flowing in the funnel 6 from the bottom 4*a* of the platform 4 so as to prevent objects from falling into the funnel 6 and blocking it, the grid of filtering 12 being removable to facilitate the maintenance of the funnel 6.

The filtering grid 12 is a toothed plate 12*a* comprising a comb-shaped cutout 12*b* in order to allow the flow of water and the retention of the objects, said toothed plate 12*a* being preferably mounted under a horizontal support 12*c* placed on the means for supporting the tap, said horizontal support 12*c* for placing objects thereon.

The various elements of the wall-mounted sanitary equipment 1 are made of plastic and/or metal.

A decorative coating 19 is disposed on the face of the bottom 4*a* of the platform 4 10 opposite to that serving as a platform in the use position.

Figure 5:
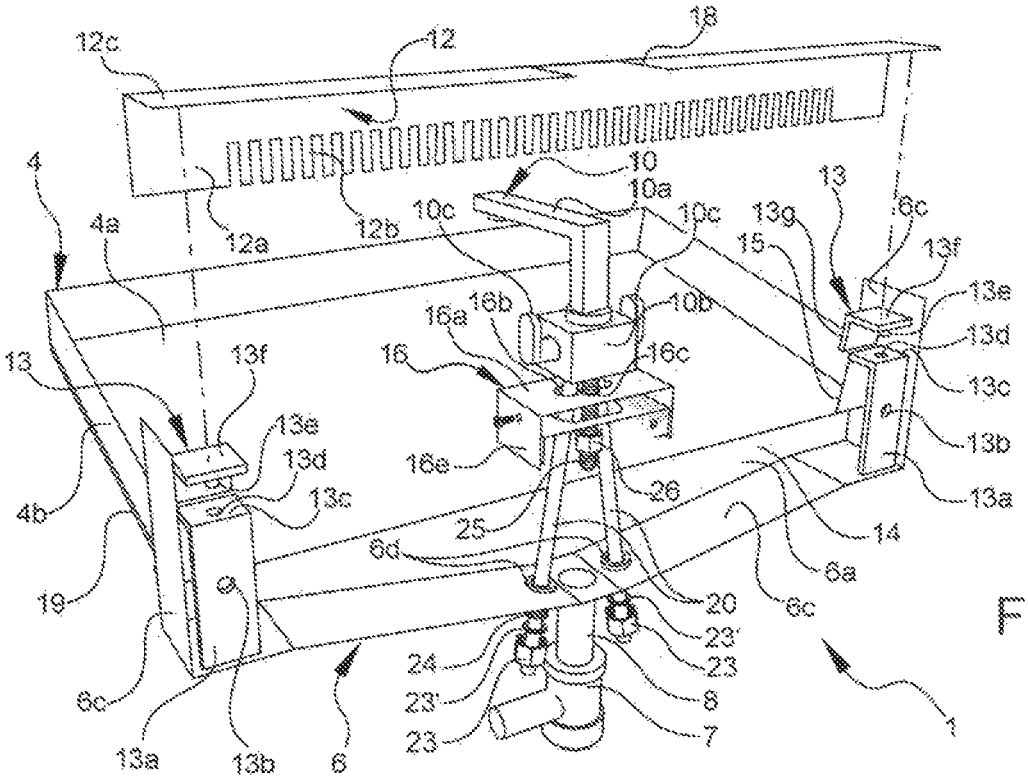
FIG. 5 is an exploded view of the wall-mounted sanitary equipment of FIG. 2.

Referring to FIG. 5, it can be seen that there is shown an exploded view of the wall-mounted sanitary equipment 1 according to the first embodiment. The box 3 of the wall-mounted sanitary equipment 1 has not been shown in FIG. 5 to facilitate the understanding of the reader.

The horizontal support 12*c* of the removable filtering grid 12 includes an opening 18 configured to allow the passage of a means for supplying water therethrough. The means for supplying water will be described in more detail later.

The funnel 6 comprises a vertical front wall 6*a*, a vertical rear wall (not shown in FIG. 5) and a sidewall 6*c* connecting said front wall 6*a* and said rear wall.

The funnel 6 thus has an upper collection opening 14 for collecting the wastewater from the platform 4 and a lower discharge end 8 sealingly connected to a means for receiving the wastewater.

In the position of use of the platform 4, is held horizontally by an abutment means 13 to serve as a basin which guides the water dispensed by the tap 10 to the funnel 6, the bottom 4*a* of the platform 4 extending, in the position of use, overhanging above the collecting opening 14 of the funnel 6.

The peripheral edge 4*b* of the bottom edge 4*a* overhanging above the collection opening 14 of the funnel 6 has an opening 15 to allow the wastewater from the platform 4 to pass to the funnel 6.

The removable filtering grid 12 is disposed upstream of the opening 15 (in the direction of the flow of water in use, from the platform 4 to the funnel 6) in the peripheral edge 4*b* of the platform 4.

The sidewall 6*c* of the funnel 6 comprises two openings 6*d* configured to allow the passage of two water supply pipes 20 sealingly therethrough.

The abutment means 13 is constituted by two inverted U-shaped parts, one 13*g* of the branches 13*a*, 13*g* of the U being intended to abut against the peripheral edge 4*b* of the platform 4 in the position of use of the platform 4. Each inverted U-shaped piece consists of two interlocking parts. The first interlocking portion is fixed and has an inverted L shape comprising the vertical leg 13*a* and a horizontal leg 13*c*, the vertical leg 13*a* being screwed onto the rear wall of the funnel 6 through the hole 13*b* formed in it. The second nestable portion is removable and has an inverted L shape including the vertical leg 13*g* and a horizontal leg 13*f*, the lower surface of the horizontal leg 13*f* having a projection 13*e* configured to fit into a hole 13*d* formed in the horizontal leg 13*c* of the first nestable part.

The horizontal branch 13*f* of each second interlocking part also serves as a support for the removable filtering grid 12.

The tap 10 is mounted on a horizontal support 16 which comprises a horizontal base 16*a* having two holes 16*b* formed to allow the passage of the water supply pipes 20 of the tap 10 and a hole 16*c* formed to allow the passage of a rod threaded 25 for fixing the tap 10 with a nut 26. The horizontal support 16 further comprises two side walls 16*e* and a front wall which make it possible to conceal the connections of the tap 10.

Each water supply pipe 20 is a malleable metal tube, preferably made of copper, sealingly passing through the sidewall 6*c* of the funnel 6 near the discharge end 8 of the funnel 6.

Each malleable metal water supply pipe 20 is configured to be clampably clamped to the sidewall 6*c* of the funnel 6 through an O-ring nut 23 configured to be screwed onto a thread 24 disposed on the outer face of the sidewall 6*c* of the funnel 6.

The screwing of the O-ring nut 23 to the thread 24 allows the malleable metal water supply pipe 20 to pass through the sidewall 6*c* of the funnel 6 in a sealed manner while being locked in position.

Thus, each water supply pipe 20 passes through the volume of the funnel 6 and passes through the sidewall 6*c* of the funnel 6 in a sealed manner, so that the bulk of the internal connection of the wall-mounted sanitary equipment 1 is reduced.

Figure 8:
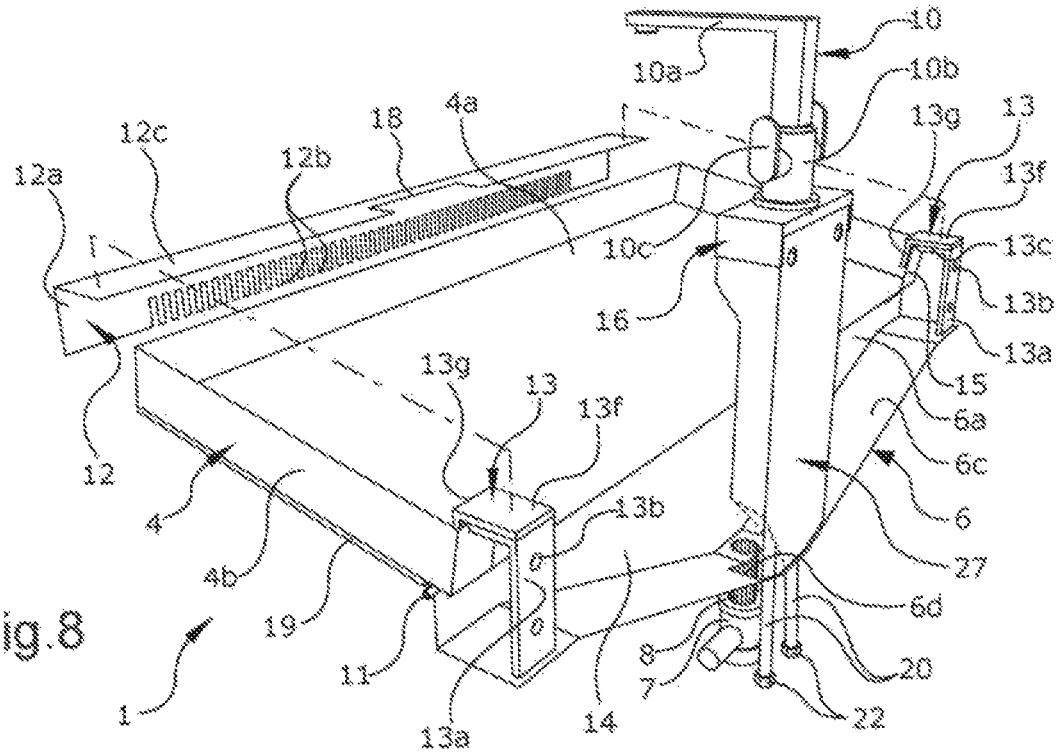
FIG. 8 is a perspective view of a variant of the wall-mounted sanitary equipment of FIG. 5.

Referring to FIG. 8, it can be seen that there is shown a variant of the wall-mounted sanitary equipment 1 according to the first embodiment.

In this variant of the first embodiment, the wall-mounted sanitary equipment 1 further comprises a hollow column 27, disposed between the horizontal tap support 16 and the bottom of the funnel 6, in which the feed pipes water 20 pass through, the bottom of the funnel 6 comprising a hole 6*d* sealingly connected to the funnel end of the hollow column 27, thus the hollow column 27, which passes through the volume of the funnel 6, raises the tap 10 while hiding the water supply pipes 20 which are connected to the tap 10.

Each of the ends of the water supply pipes 20 opposed to the tap 10 comprise a sealing nut 22 to allow a sealed connection to a water inlet from the outside.

Figure 3:
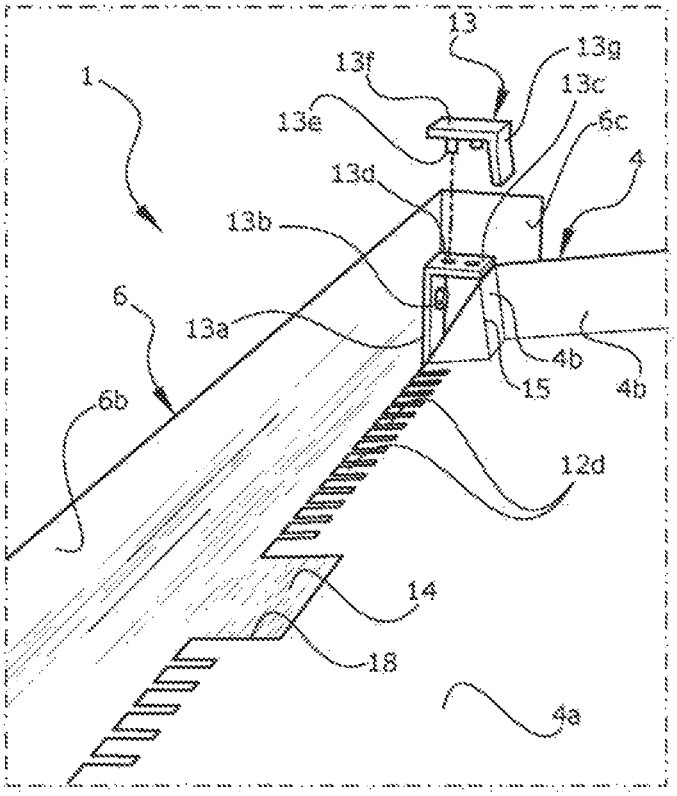
FIG. 3 is a perspective view of a wall-mounted sanitary equipment according to a second embodiment.

Referring to FIG. 3, it can be seen that there is shown a wall-mounted sanitary 35 equipment 1 according to the second embodiment.

The common elements between the first embodiment of the invention in FIGS. 1, 2, 5, and 8 and this second embodiment of the invention bear the same reference numeral and will not be described in more detail here when they are identical structures.

The tap 10 and its connections have not been shown in FIG. 3 to facilitate the understanding of the reader.

The funnel 6 has the front vertical wall 6 a (not shown in FIG. 3) and the rear vertical wall 6*b* which are parallel and interconnected by the sidewall 6*c*. In this second embodiment, the filter medium support is the bottom 4*a* of the platform 4, and the filtering means is constituted by a comb-shaped cut 12*d* formed on the edge of the bottom 4*a* of the platform 4 overhanging the above the collection opening 14 of the funnel 6. Thus, the comb-shaped cut 12*d* makes it possible to coarsely filter the wastewater flowing in the funnel 6 from the bottom of the platform 4*a* in order to prevent objects from falling into the funnel 6 and blocking it.

Furthermore, in this second embodiment, it should be noted that the opening 18 is carried by the edge of the bottom 4*a* of the platform 4 overhanging above the collection opening 14 of the funnel 6.

Figure 4:
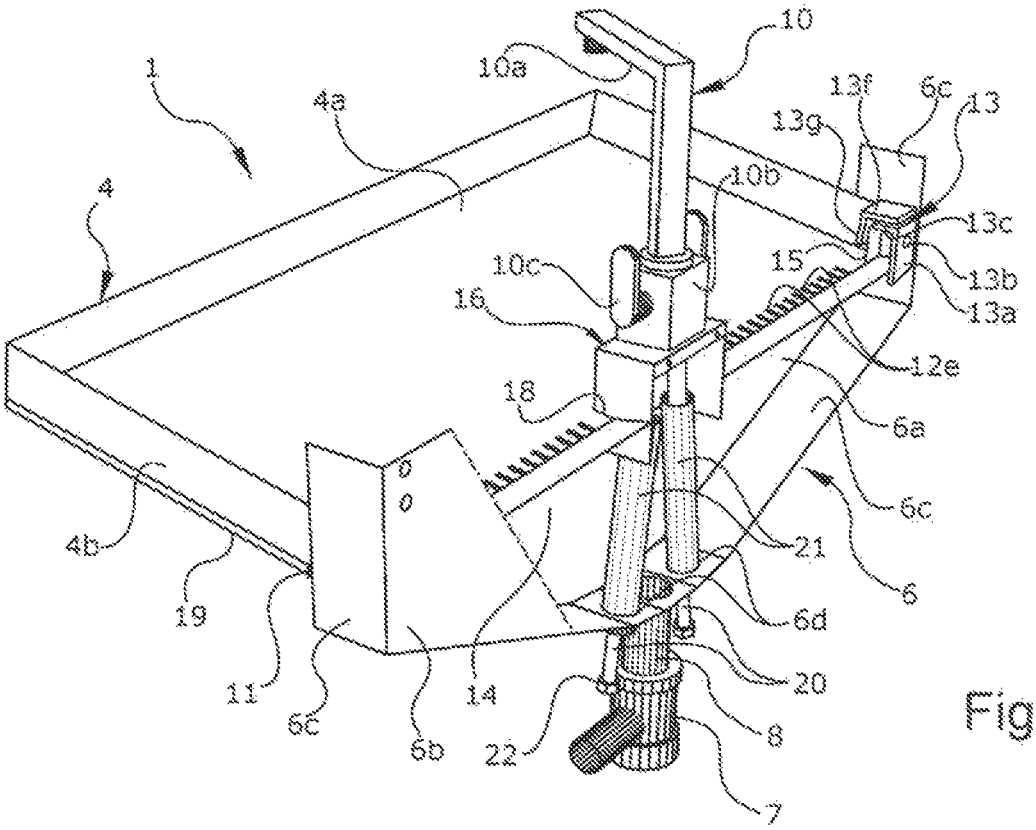
FIG. 4 is a perspective view of a wall-mounted sanitary equipment according to a third embodiment.

Referring to FIG. 4, it can be seen that there is shown a wall-mounted sanitary equipment 1 according to the third embodiment.

The common elements between the second embodiment of the invention in FIG. 3 and this third embodiment of the invention bear the same reference numeral and will not be described in more detail here when they are identical structures.

In this third embodiment, the filter medium support is the bottom 4*a* of the platform 4, and the filtering means is constituted by perforations 12*e* formed in the bottom 4*a* of the platform 4 overhanging above the opening of collecting 14 of the funnel 6 in the position of use of the platform 4. Thus, the perforations 1 2*e* in the bottom 4*a* of the platform 4 allow coarse filtering wastewater flowing in the funnel 6 from the bottom 4*a* of the platform 4 to prevent objects from falling into the funnel 6 and do not block it.

In addition, in the third embodiment, each water supply pipe 20 is a flexible pipe passing through a rigid guide tube 21 which is arranged in the funnel 6 and which passes through the sidewall 6*c* of the funnel 6 at the discharge end 8 of the funnel 6 through the holes 6*d*.

Each rigid guide tube 21 is welded to the sidewall 6*c* of the funnel 6, and allows the water supply pipe 20 to pass sealingly through the sidewall 6*c* of the funnel 6 and then to be connected to the corresponding water inlet by a tight clamping nut 22. Each flexible water supply pipe is preferably a rubber tube coated with a metal weave.

Figure 6:
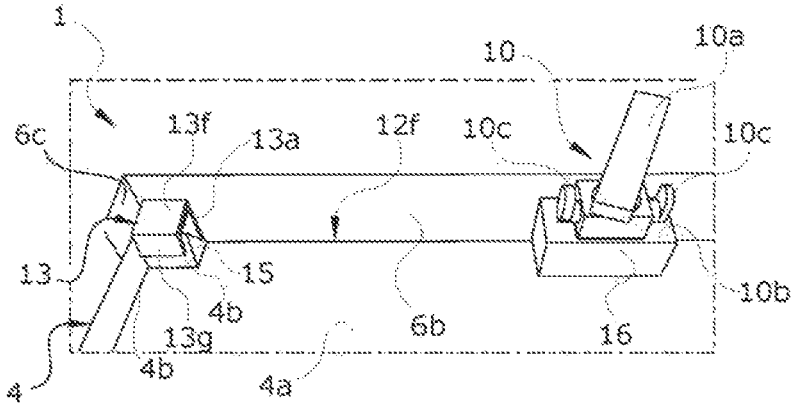
FIG. 6 is a perspective view of a wall-mounted sanitary equipment according to a fourth embodiment.

Referring to FIG. 6, it can be seen that there is shown a wall-mounted sanitary equipment 1 according to the fourth embodiment.

The common elements between the third embodiment of the invention in FIG. 4 and this fourth embodiment of the invention bear the same reference numeral and will not be described in more detail here when they are identical structures.

In this fourth embodiment, the filter medium support is the bottom 4*a* of the platform 4, and the filtering means is constituted by a spacing 12*f* between 1 mm and 10 mm, preferably equal to 2 mm, between the edge the bottom 4*a* of the platform 4 overhanging above the collecting opening 14 of the funnel 6 and the point of the rear wall 6*b* of the funnel 6 farthest from said bottom edge 4*a* of the platform 4 in the plane of the bottom 4*a* of the platform 4 in the position of use of the platform 4. Thus, the spacing 12*f* of reduced size between the bottom edge 4*a* of the platform 4 and the rear wall 6*b* of the funnel 6 allows coarse filtering wastewater flowing in the funnel 6 from the bottom 4*a* of the platform 4 to prevent objects from falling into the funnel 6 and blocking it.

Figure 7:
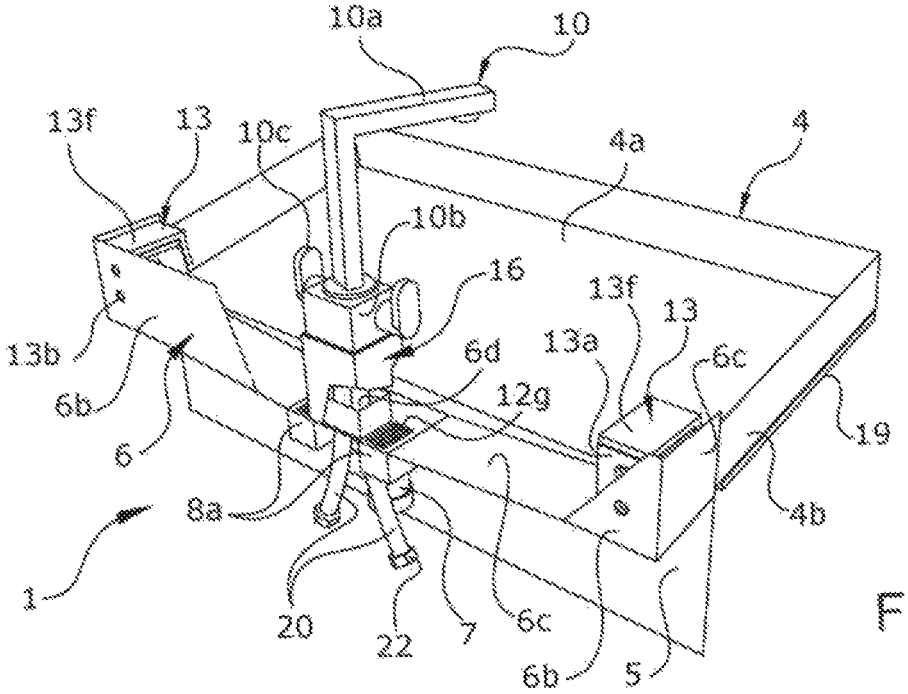
FIG. 7 is a perspective view of a sanitary wall equipment according to a fifth embodiment.

Referring to FIG. 7, it can be seen that there is shown a wall-mounted sanitary equipment 1 according to the fifth embodiment.

The common elements between the first embodiment of the invention in FIGS. 1, 2, and 5 and this second embodiment of the invention bear the same reference numeral and will not be described in more detail here when they are identical structures.

In this fifth embodiment, the horizontal tap support 16 is in the form of a hollow column disposed between the tap 10 and the bottom of the funnel 6, in which the water supply pipes 20 pass, the bottom of the funnel 6 comprising a hole 6*d* sealingly connected to the funnel end of said hollow column.

In addition, in the fifth embodiment, the filter medium support is the discharge end 8 of the funnel 6, and the filtering means is constituted by two filtering grids 12*g* disposed at the discharge end 8 of the funnel 6, on either side of the hole 6*d* in the side wall 6*c* of the funnel 6. Thus, the filtering grids 12*g* in the discharge end 8 of the funnel 6 make it possible to coarsely filter the wastewater flowing in the siphon 7 from the funnel 6 in order to prevent 20 objects from falling into the siphon 7 and do not block it.

It should be noted that the opening 6*d* in the sidewall 6*c* of the funnel 6 and the opening 18 in the filter medium support are common in this fifth embodiment.

The discharge end 8 further comprises two compartments 8*a* respectively disposed under the two filtering grids 12*g* and sealingly connected to the siphon 7.

Thus, in each of the five embodiments of the invention, the size of the wall-mounted sanitary equipment 1 is reduced and its assembly/disassembly is facilitated.

The invention claimed is:

1. A wall-mounted sanitary equipment, comprising:

a support;

water supply means;

tap support means configured to receive a tap carrying a rotatable dispensing head the tap support means being configured to sealingly connect the tap to the water supply means;

means for collecting wastewater; and a platform having a bottom and a peripheral edge surrounding at least part of the bottom so that the platform is configured to form a basin under the rotatable dispensing head of the tap;

wherein the means for collecting wastewater comprises a funnel having an upper collection opening for collecting wastewater from the platform;

wherein the funnel further comprises a lower discharge end sealingly connected to means for receiving wastewater, the bottom of the platform being pivotally mounted between two positions, a first position for storage where the platform is folded in a vertical position, and a second position for use, where the platform is held horizontally by a stop means to serve as a basin that water distributed by the tap to the means for collecting wastewater;

wherein the bottom of the platform extends, in the position of use, overhanging above the collection opening of the funnel, the peripheral edge of the bottom overhanging above the collection opening of the funnel having at least one opening to allow the wastewater from the platform to pass to the funnel;

a filtering means disposed on a filter support and configured to filter the wastewater before passing to the means for receiving the wastewater; and wherein the funnel comprises at least one opening configured to allow passage of the water supply means in a sealed manner therethrough, the filter support means comprising at least one opening configured to allow passage of the water supply means therethrough, and wherein the filter support means is the bottom of the platform, and the filtering means is constituted by a cut in comb form formed on the edge of the bottom of the platform overhanging above the collection opening of the funnel.

2. The wall-mounted sanitary equipment according to claim 1, wherein the filtering means is arranged upstream of the collection opening of the funnel.

3. The wall-mounted sanitary equipment according to claim 1, wherein the filtering means is disposed downstream of the collection opening of the funnel.

4. The wall-mounted sanitary equipment according to claim 1, wherein the support of filter means is the bottom of the platform, the funnel comprises a rear wall, and the filtering means is constituted by a spacing of between 1 mm and 10 mm between the edge of the bottom of the platform overhanging above the collecting opening of the funnel and the point of the rear wall of the funnel furthest from the edge of the bottom of the platform in a plane of the bottom of the platform in the use position of the platform.

5. The wall-mounted sanitary equipment according to claim 1, wherein the support of filter means is the bottom of the platform, and the filtering means is constituted by perforations formed in the bottom of the platform overhanging above the collection opening of the funnel in the position of use of the platform.

6. The wall-mounted sanitary equipment according to claim 1, wherein the support of filter means is the bottom of the platform and the filtering means is constituted by a removable filtering grid arranged upstream of at least one opening in the platform.

7. The wall-mounted sanitary equipment according to claim 1, wherein the support of filter means is the lower discharge end of the funnel, and the filtering means is constituted by at least one filtering grid disposed in the lower discharge end of the funnel.

8. The wall-mounted sanitary equipment according to claim 1, further comprising a tap fixed on the tap support means, wherein the water supply means is constituted by at least one water supply connection that is watertight, and the means for receiving wastewater is constituted by a leaktight drain connection connected sealingly to the lower discharge end of the funnel, the tap being sealingly connected to each of the at least one water supply connection by a respective water supply pipe, each respective water supply pipe sealingly traversing a side wall of the funnel to connect the tap to a corresponding water supply inlet connection.

9. The wall-mounted sanitary equipment according to claim 8, wherein each water supply pipe is one of: a flexible pipe passing through a rigid guide tube which is disposed in the funnel and which sealingly traverses the side wall of the funnel.

10. The wall-mounted sanitary equipment according to claim 9, wherein the tap support means is a horizontal support fixed to the support overhanging the funnel, each supply pipe of water being sealingly connected to a corresponding water inlet of the tap.

11. The wall-mounted sanitary equipment according to claim 8, wherein the tap comprises two water inlets each sealingly connected to a water supply pipe respectively, the tap being one of mixer single-lever or mixer dual-lever.

12. The wall-mounted sanitary equipment according to claim 8, further comprising a siphon disposed between the lower discharge end of the funnel and the means for receiving wastewater.

13. The wall-mounted sanitary equipment according to claim 1, characterized in that the platform comprises a handle on the bottom face opposite to that serving as a basin in the use position.

14. The wall-mounted sanitary equipment according to claim 1, further comprising abutment means comprising two inverted U-shaped parts, one of the branches of the U-shaped parts being configured to abut against the peripheral edge of the platform.

15. The wall-mounted sanitary equipment according to claim 14, wherein each U-shaped part comprises two interlocking parts, one of the two parts being fixed and the other of the two parts being removable, the part dismountable comprising an edge of a U of the U-shaped part for abutting against the peripheral edge of the platform, the fixed part comprising another edge of the U which is fixed on the funnel.

16. The wall-mounted sanitary equipment according to claim 1, wherein;

the support of the sanitary equipment wall is a box configured to be installed against a wall or recessed in a recess formed in a wall, and the box is transportable; and the box comprises fixing means, and an upper part comprising the platform and the tap and a lower part comprising the funnel, a depth of the funnel, a and a height of the peripheral edge of the platform being equal to or less than a depth of the box, and a width of the collecting opening of the funnel being equal to a width of the box.

17. The wall-mounted sanitary equipment according to claim 16, wherein the water inlet and wastewater outlet connections are defined by holes in the lower part of the box.

18. The wall-mounted sanitary equipment according to claim 16, wherein the lower part of the box has, on the front face, a removable access door.

19. The wall-mounted sanitary equipment according to claim 16, wherein the box comprises hinges fixed to at least one of the platform, the funnel, and the support that allows the platform to pivot between the first position for storage the second position for use.

20. The wall-mounted sanitary equipment according to claim 16, wherein the box further comprises a locking element in the first position for storage of the platform.

21. The wall-mounted sanitary equipment according to claim 16, wherein the box further comprises decorative coatings disposed on a front face of the box.

22. The wall-mounted sanitary equipment according to claim 16, wherein the box is rectangular parallelepiped and has a thickness of between 2 cm and 15 cm.

23. The wall-mounted sanitary equipment according to claim 1, wherein at least one of:

the platform is removable;

the tap support means is removable to facilitate the attachment of the tap; and the lower discharge end of the funnel is centered in the width of the lower part of the box, or is shifted towards a lateral side of the lower part of the box, a storage space being provided in the lower part of the box in the case where the end of evacuation of the funnel is shifted.

24. A wall-mounted sanitary equipment, comprising:

a support;

water supply means;

tap support means configured to receive a tap carrying a rotatable dispensing head the tap support means being configured to sealingly connect the tap to the water supply means;

means for collecting wastewater; and a platform having a bottom and a peripheral edge surrounding at least part of the bottom so that the platform is configured to form a basin under the rotatable dispensing head of the tap;

wherein the means for collecting wastewater comprises a funnel having an upper collection opening for collecting wastewater from the platform;

wherein the funnel further comprises a lower discharge end sealingly connected to means for receiving wastewater, the bottom of the platform being pivotally mounted between two positions, a first position for storage where the platform is folded in a vertical position, and a second position for use, where the platform is held horizontally by a stop means to serve as a basin that water distributed by the tap to the means for collecting wastewater;

wherein the bottom of the platform extends, in the position of use, overhanging above the collection opening of the funnel, the peripheral edge of the bottom overhanging above the collection opening of the funnel having at least one opening to allow the wastewater from the platform to pass to the funnel;

a filtering means disposed on a filter support and configured to filter the wastewater before passing to the means for receiving the wastewater; and wherein the funnel comprises at least one opening configured to allow passage of the water supply means in a sealed manner therethrough, the filter support comprising at least one opening configured to allow passage of the water supply means therethrough; and wherein the filter support is the bottom of the platform, the funnel comprises a rear wall, and the filtering means is constituted by a spacing of between 1 mm and 10 mm between the edge of the bottom of the platform overhanging above the collecting opening of the funnel and the point of the rear wall of the funnel furthest from the edge of the bottom of the platform in a plane of the bottom of the platform in the use position of the platform.

25. A wall-mounted sanitary equipment, comprising:

a support;

water supply means;

tap support means configured to receive a tap carrying a rotatable dispensing head the tap support means being configured to sealingly connect the tap to the water supply means;

means for collecting wastewater; and a platform having a bottom and a peripheral edge surrounding at least part of the bottom so that the platform is configured to form a basin under the rotatable dispensing head of the tap;

wherein the means for collecting wastewater comprises a funnel having an upper collection opening for collecting wastewater from the platform;

wherein the funnel further comprises a lower discharge end sealingly connected to means for receiving wastewater, the bottom of the platform being pivotally mounted between two positions, a first position for storage where the platform is folded in a vertical position, and a second position for use, where the platform is held horizontally by a stop means to serve as a basin that water distributed by the tap to the means for collecting wastewater;

wherein the bottom of the platform extends, in the position of use, overhanging above the collection opening of the funnel, the peripheral edge of the bottom overhanging above the collection opening of the funnel having at least one opening to allow the wastewater from the platform to pass to the funnel;

a filtering means disposed on a filter support and configured to filter the wastewater before passing to the means for receiving the wastewater; and wherein the funnel comprises at least one opening configured to allow passage of the water supply means in a sealed manner therethrough, the filter support comprising at least one opening configured to allow passage of the water supply means therethrough; and abutment means comprising two inverted U-shaped parts, one of the branches of the U-shaped parts being configured to abut against the peripheral edge of the platform.

* * * * *